US008839593B2

(12) United States Patent
Barrett et al.

(10) Patent No.: US 8,839,593 B2
(45) Date of Patent: Sep. 23, 2014

(54) PRE-CAST BLOCKS FOR USE IN COLUMN CONSTRUCTION

(75) Inventors: David Barrett, Selinsgrove, PA (US); Derek Zimmerman, Mifflinburg, PA (US); David Jacobson, Liberty Township, OH (US); Randy Quaintance, York, NE (US); John C Purvis, Cary, NC (US)

(73) Assignee: Ply Gem Industries, Inc., Cary, NC (US)

( * ) Notice: Subject to any disclaimer, the term of this patent is extended or adjusted under 35 U.S.C. 154(b) by 0 days.

(21) Appl. No.: 13/030,021

(22) Filed: Feb. 17, 2011

(65) Prior Publication Data

US 2011/0283657 A1 Nov. 24, 2011

Related U.S. Application Data

(60) Provisional application No. 61/305,289, filed on Feb. 17, 2010.

(51) Int. Cl.

| | |
|---|---|
| ***E04C 3/34*** | (2006.01) |
| ***E04B 1/04*** | (2006.01) |
| ***E04B 1/02*** | (2006.01) |
| ***E04H 12/12*** | (2006.01) |

(52) U.S. Cl.

CPC . *E04C 3/34* (2013.01); *E04H 12/12* (2013.01)
USPC ..... 52/834; 52/404.1; 52/405.4; 52/582.1; 52/605; 52/612

(58) Field of Classification Search

CPC ..... E04C 3/30; E04C 3/34; E04C 3/36; E04C 1/41; E04C 1/395; E04H 12/12; E04B 2002/0269
USPC ..... 52/605, 606, 607, 831, 834, 836, 837, 52/838, 841, 844, 845, 847, 848, 404.1, 52/405.1, 405.3, 405.4, 582.1, 439, 596, 52/612

See application file for complete search history.

(56) References Cited

U.S. PATENT DOCUMENTS

| | | | | | |
|---|---|---|---|---|---|
| 1,350,686 | A | * | 8/1920 | Trudelle | 52/834 |
| 1,761,848 | A | * | 6/1930 | Sitzman et al. | 52/125.4 |
| 2,151,468 | A | * | 3/1939 | Henderson | 52/204.1 |
| 2,611,261 | A | * | 9/1952 | Preston | 52/347 |
| 3,261,138 | A | * | 7/1966 | Spence et al. | 52/612 |
| 3,298,668 | A | * | 1/1967 | Schueren | 256/19 |
| 3,346,198 | A | * | 10/1967 | Roberts et al. | 241/23 |
| 3,413,967 | A | * | 12/1968 | Hoock | 431/288 |
| 3,566,568 | A | * | 3/1971 | Slobodian | 52/309.9 |
| 3,885,363 | A | * | 5/1975 | Whittey | 52/125.3 |
| 4,002,002 | A | * | 1/1977 | Barnhardt, Jr. | 264/46.6 |

(Continued)

*Primary Examiner* — Basil Katcheves
*Assistant Examiner* — Rodney Mintz
(74) *Attorney, Agent, or Firm* — Lathrop & Gage LLP

(57) ABSTRACT

A decorative column comprising a rigid center post, a plurality of pre-cast pieces with each piece having a hole extending therethrough so the pre-cast piece slides onto the center post and remains in place on the center post. Each pre-cast piece being stacked upon another pre-cast piece, the pre-cast pieces being of a predefined shape, and a compressible center core liner filling a portion of the hole of the pre-cast piece. The compressible center core including a cutout shape consistent with the cross sectional shape of the rigid center post thereby allowing passage of the center post through the compressible center core.

4 Claims, 5 Drawing Sheets

(56) References Cited

U.S. PATENT DOCUMENTS 4,027,445 A * 6/1977 Nickerson ..... 52/405.1
4,038,798 A * 8/1977 Sachs ..... 52/309.7
4,193,241 A * 3/1980 Jensen et al. ..... 52/405.4
4,330,632 A * 5/1982 Haynes et al. ..... 501/140
4,348,845 A * 9/1982 Iannarelli ..... 52/405.3
4,462,195 A * 7/1984 Nickerson ..... 52/405.1
4,506,483 A * 3/1985 Phalen, Jr. ..... 52/408
4,535,579 A * 8/1985 Burgoyne et al. ..... 52/408
4,551,959 A * 11/1985 Schmid ..... 52/309.12
4,565,469 A * 1/1986 Chlumecky ..... 405/288
4,631,885 A * 12/1986 Iannarelli ..... 52/405.2
4,728,471 A * 3/1988 Kyffin et al. ..... 264/43
4,887,405 A * 12/1989 Nickerson ..... 52/309.12
4,906,183 A * 3/1990 Kyffin et al. ..... 432/138
4,962,621 A * 10/1990 Pura ..... 52/218
4,986,049 A * 1/1991 Kennedy et al. ..... 52/309.12
5,024,035 A * 6/1991 Hanson et al. ..... 52/591.1
5,062,244 A * 11/1991 Ducharme ..... 52/98
5,066,440 A * 11/1991 Kennedy et al. ..... 264/69
5,160,772 A * 11/1992 Futami et al. ..... 428/71
5,209,037 A * 5/1993 Kennedy et al. ..... 52/309.12
5,291,706 A * 3/1994 Beardsley et al. ..... 52/218
5,321,926 A * 6/1994 Kennedy ..... 52/405.1
5,349,798 A * 9/1994 Gross ..... 52/405.1
5,501,057 A * 3/1996 Dawson ..... 52/761
5,561,956 A * 10/1996 Englekirk et al. ..... 52/223.13
5,568,709 A * 10/1996 Steckler ..... 52/309.8
5,725,652 A * 3/1998 Shulman ..... 106/677
5,749,191 A * 5/1998 Schmid ..... 52/405.1
5,755,216 A * 5/1998 Salyer ..... 126/618
5,761,861 A * 6/1998 Brackett ..... 52/218
5,822,939 A * 10/1998 Haener ..... 52/405.2
5,921,046 A * 7/1999 Hammond, Jr. ..... 52/564
5,934,035 A * 8/1999 Rasmussen et al. ..... 52/300
5,937,601 A * 8/1999 McDonald ..... 52/314
6,088,987 A * 7/2000 Simmons et al. ..... 52/592.6
6,119,426 A * 9/2000 Escudero
6,164,035 A * 12/2000 Roberts ..... 52/563
6,185,888 B1 * 2/2001 Wasson ..... 52/300
6,199,345 B1 * 3/2001 Dean ..... 52/745.17
6,282,859 B1 * 9/2001 Van Der Heijden ..... 52/585.1
6,349,522 B1 * 2/2002 Stevens ..... 52/749.13
6,442,913 B1 * 9/2002 Mann ..... 52/745.09
6,453,625 B1 * 9/2002 Corbett ..... 52/125.3
6,513,293 B2 * 2/2003 Miller ..... 52/405.1
6,513,296 B1 * 2/2003 Baden ..... 52/562
6,557,316 B2 * 5/2003 Van Der Heijden ..... 52/585.1
6,568,143 B2 * 5/2003 Coleman ..... 52/604
6,571,521 B1 * 6/2003 Ameigh ..... 52/295
6,571,525 B2 * 6/2003 Coleman ..... 52/592.5
6,616,752 B1 * 9/2003 Basura et al. ..... 106/716
6,758,020 B2 * 7/2004 Cerrato ..... 52/606
6,763,640 B2 * 7/2004 Lane ..... 52/300
6,889,479 B2 * 5/2005 Thorpe ..... 52/596
6,986,231 B2 * 1/2006 Koszo ..... 52/834
6,996,945 B2 * 2/2006 Doty ..... 52/585.1
7,080,827 B1 * 7/2006 McCannon, Jr. ..... 256/19
7,163,140 B1 * 1/2007 Kaiser ..... 232/38
7,387,472 B2 * 6/2008 Abella ..... 405/284
7,438,757 B2 * 10/2008 Williams et al. ..... 106/724
7,476,273 B2 * 1/2009 Williams ..... 106/713
7,546,712 B2 * 6/2009 Shaw ..... 52/223.8
7,641,178 B2 * 1/2010 MacDonald et al. ..... 256/19
7,739,845 B2 * 6/2010 Kennedy ..... 52/405.3
7,984,594 B1 * 7/2011 Propst ..... 52/309.12
8,015,775 B2 * 9/2011 McMullen et al. ..... 52/834
8,033,069 B2 * 10/2011 Hotchkiss, III ..... 52/405.3
8,127,509 B2 * 3/2012 Propst ..... 52/309.12
8,146,326 B2 * 4/2012 McMullen et al. ..... 52/834
8,297,012 B2 * 10/2012 Nunez-Vargas ..... 52/223.7
8,454,742 B2 * 6/2013 Scanlan ..... 106/400
8,458,983 B2 * 6/2013 Propst ..... 52/741.41
8,464,482 B2 * 6/2013 Raynor ..... 52/296
8,464,491 B2 * 6/2013 MacDonald et al. ..... 52/606
8,469,321 B2 * 6/2013 Nolfi, Jr. ..... 248/73
8,549,808 B2 * 10/2013 Badin ..... 52/405.4
8,555,584 B2 * 10/2013 Ciuperca ..... 52/309.7
8,590,243 B2 * 11/2013 Jorgensen et al. ..... 52/406.1
2002/0170264 A1 * 11/2002 Koszo ..... 52/737.4
2003/0089068 A1 * 5/2003 Ameigh ..... 52/606
2003/0109592 A1 * 6/2003 Shulman ..... 521/54
2003/0145765 A1 * 8/2003 Boronkay ..... 106/724
2003/0150185 A1 * 8/2003 Godeke et al. ..... 52/576
2004/0006943 A1 * 1/2004 Weick ..... 52/315
2004/0221538 A1 * 11/2004 Thorpe ..... 52/596
2004/0226246 A1 * 11/2004 Doty ..... 52/503
2005/0252118 A1 * 11/2005 Matsufuji ..... 52/223.7
2005/0252146 A1 * 11/2005 MacDonald et al. ..... 52/606
2005/0252147 A1 * 11/2005 MacDonald et al. ..... 52/606
2005/0257481 A1 * 11/2005 Shaw ..... 52/606
2006/0032184 A1 * 2/2006 Almeter ..... 52/736.3
2006/0059838 A1 * 3/2006 Pimental ..... 52/596
2006/0201090 A1 * 9/2006 Guevara et al. ..... 52/309.12
2006/0217464 A1 * 9/2006 Guevara et al. ..... 524/2
2006/0225618 A1 * 10/2006 Guevara et al. ..... 106/677
2007/0012219 A1 * 1/2007 Williams ..... 106/400
2007/0044413 A1 * 3/2007 Gossett ..... 52/596
2007/0062143 A1 * 3/2007 Noushad ..... 52/426
2007/0062415 A1 * 3/2007 Guevara et al. ..... 106/638
2007/0107333 A1 * 5/2007 Marsh et al. ..... 52/223.7
2007/0157537 A1 * 7/2007 Nicolson et al. ..... 52/596
2007/0245673 A1 * 10/2007 Cerrato ..... 52/607
2007/0251182 A1 * 11/2007 Van Steinburg ..... 52/586.1
2007/0266662 A1 * 11/2007 Oram et al. ..... 52/311.1
2008/0057290 A1 * 3/2008 Guevara et al. ..... 428/312.4
2008/0058446 A1 * 3/2008 Guevara et al. ..... 524/2
2008/0060312 A1 * 3/2008 Hung ..... 52/596
2008/0172970 A1 * 7/2008 MacDonald et al. ..... 52/574
2008/0184650 A1 * 8/2008 Fischer ..... 52/606
2008/0236081 A1 * 10/2008 Kennedy ..... 52/405.1
2008/0275149 A1 * 11/2008 Ladely et al. ..... 521/55
2008/0314290 A9 * 12/2008 Williams ..... 106/400
2008/0314295 A1 * 12/2008 Guevara et al. ..... 106/668
2009/0057531 A1 * 3/2009 Waite et al. ..... 249/48
2009/0120023 A1 * 5/2009 Hoggan et al. ..... 52/300
2009/0272057 A1 * 11/2009 Hotchkiss, III ..... 52/309.17
2010/0064620 A1 * 3/2010 MacDonald et al. ..... 52/592.6
2010/0064943 A1 * 3/2010 Guevara et al. ..... 106/672
2010/0088984 A1 * 4/2010 Guevara et al. ..... 52/220.1
2010/0098524 A1 * 4/2010 Guevara et al. ..... 414/812
2010/0144949 A1 * 6/2010 Bethani ..... 524/444
2010/0162650 A1 * 7/2010 Van Steinburg ..... 52/568
2010/0236177 A1 * 9/2010 Roberts et al. ..... 52/404.1
2010/0273902 A1 * 10/2010 Ladely et al. ..... 521/55
2010/0314596 A1 * 12/2010 Thomas ..... 256/19
2010/0319581 A1 * 12/2010 Bethani ..... 106/405
2011/0003904 A1 * 1/2011 Guevara et al. ..... 521/59
2011/0030292 A1 * 2/2011 Oram et al. ..... 52/173.1
2011/0067342 A1 * 3/2011 Hotchkiss, III ..... 52/582.1
2011/0120349 A1 * 5/2011 Andersen et al. ..... 106/712
2011/0146196 A1 * 6/2011 Moroschan ..... 52/742.13
2011/0173911 A1 * 7/2011 Propst ..... 52/309.13
2011/0214374 A1 * 9/2011 Propst ..... 52/309.17
2011/0214391 A1 * 9/2011 Guevara et al. ..... 52/800.1
2011/0265399 A1 * 11/2011 Hahn ..... 52/173.1
2011/0308188 A1 * 12/2011 Jorgensen et al. ..... 52/596
2012/0006232 A1 * 1/2012 Scanlan ..... 106/802
2012/0159765 A1 * 6/2012 Propst ..... 29/428
2012/0258282 A1 * 10/2012 Hammond ..... 428/143
2012/0305171 A1 * 12/2012 Hammond ..... 156/153
2012/0311953 A1 * 12/2012 Antal ..... 52/604
2013/0036696 A1 * 2/2013 Moroschan ..... 52/309.4
2013/0036700 A1 * 2/2013 Speer ..... 52/583.1
2013/0084424 A1 * 4/2013 Cangiano et al. ..... 428/138
2013/0134614 A1 * 5/2013 Scanlan ..... 264/40.1
2013/0145968 A1 * 6/2013 Scanlan ..... 106/676
2013/0247379 A1 * 9/2013 Propst ..... 29/897.32
2013/0291482 A1 * 11/2013 Limon Cornejo ..... 52/848
2013/0312349 A1 * 11/2013 Hileman et al. ..... 52/421

* cited by examiner

PRE-CAST BLOCKS FOR USE IN COLUMN CONSTRUCTION

RELATED APPLICATIONS

This application claims the benefit of the filing date of a provisional application with Ser. No. 61/305,289 which was filed on Feb. 17, 2010, the disclosure of which is incorporated herein by reference.

TECHNICAL FIELD

The disclosed subject matter is directed to the production of pre-cast blocks for constructing modular columns.

BACKGROUND

Decorative stone columns are widely used by homeowners and businesses for a variety of purposes such as the monuments at the entrance of a driveway, as supports between fence sections, as a base for a statue, and as pillars at the entrance to a building to name just a few uses. The construction of decorative stone columns normally requires the services of a skilled mason and the utilization of specialized masonry tools. The average individual does not typically have the necessary tools or requisite skill for constructing appropriate concrete forms or for completing decorative stone column construction. As a result, most decorative stone columns are usually constructed by a skilled mason and at a high cost. Producing a high quality, durable and aesthetically pleasing column at a reasonable cost can be accomplished with the assistance of modular column construction as is outlined below.

SUMMARY

The present invention pertains to the construction of a decorative column and the method of producing the modular blocks that comprise the decorative column. The column comprises a rigid center post surrounded by a plurality of modular blocks. Each modular block has a hole extending through it so the block can fit onto the rigid center post and remain fixed in place on the post. Each modular block is stackable upon another block of similar construction. The present invention pertains to a method for not only producing the modular blocks with compressible inserts but also the erecting of a decorative column that is capable of accommodating ground heaving due to freezing temperatures and thermal expansion which is particularly important, for example, when the column is utilized to support fence sections.

The method comprises the steps of producing a flexible mold for forming the modular blocks, positioning a compressible insert into the mold, filling the open area created by the walls of the mold and the exterior surfaces of the compressible insert with a lightweight cementitious material, waiting for the cementitious material to cure and then removing the modular block from the flexible mold.

Once the modular blocks with the compressible inserts are removed from the mold they are positioned onto the rigid center post so that the compressible insert center opening is aligned with the rigid post and can slide down the post to either the ground or atop another modular block. The process of placing the modular blocks on the center post can be repeated as necessary to produce a decorative column of the desired height.

The compressible inserts are instrumental in reducing the weight of the modular blocks as the inserts are preferably comprised of materials such as EPS foam or cellular PVC to name but a few available options. In addition, the compressible inserts facilitate placement of the modular blocks on the rigid center post particularly for posts of a substantial height as the compressible and flexible material will not bind against the post as the blocks are lowered into position on the post.

DETAILED DESCRIPTION

Figure 1:
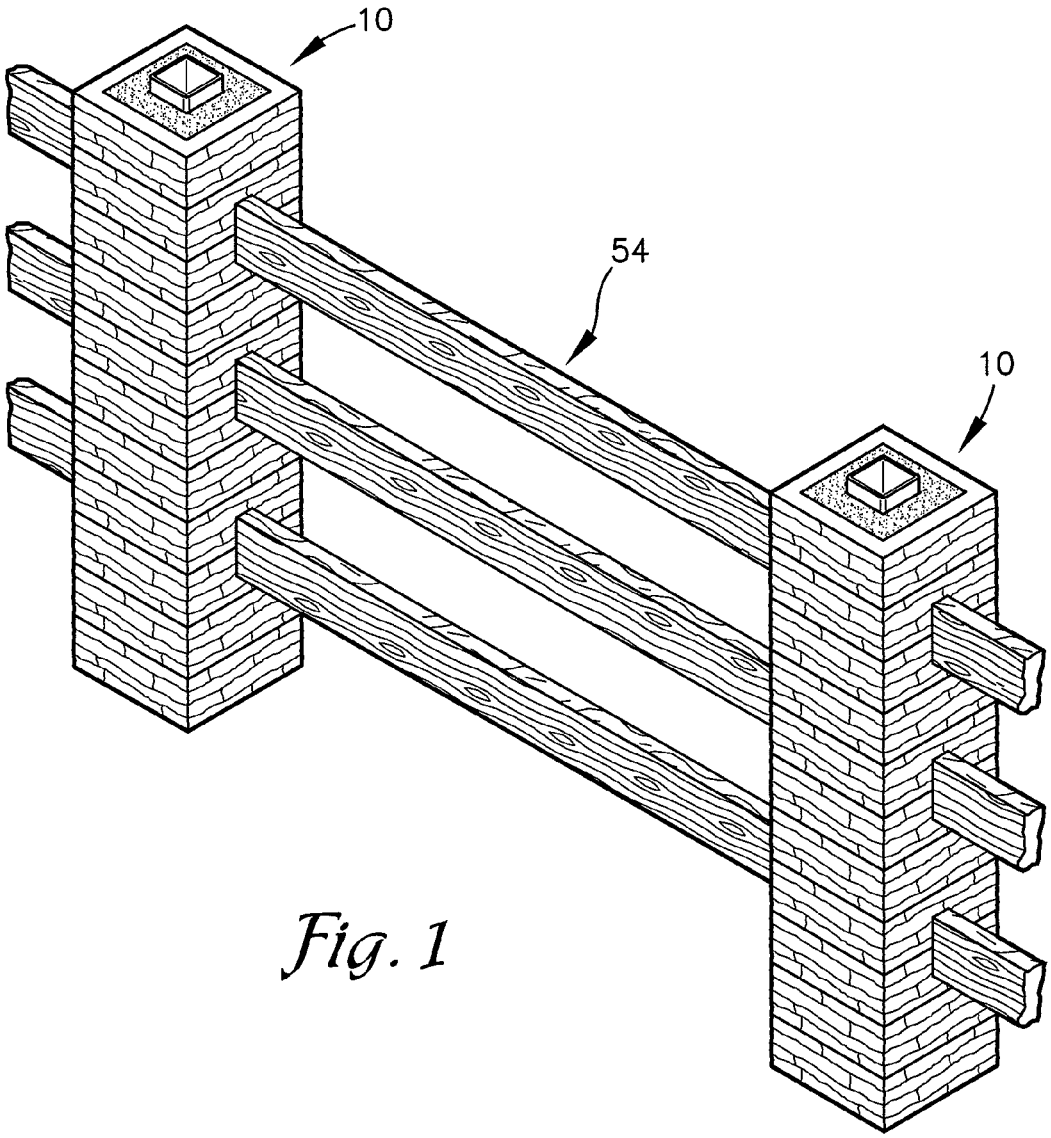
FIG. 1 is a perspective view of a three rail fence constructed with modular columns.
Figure 2:
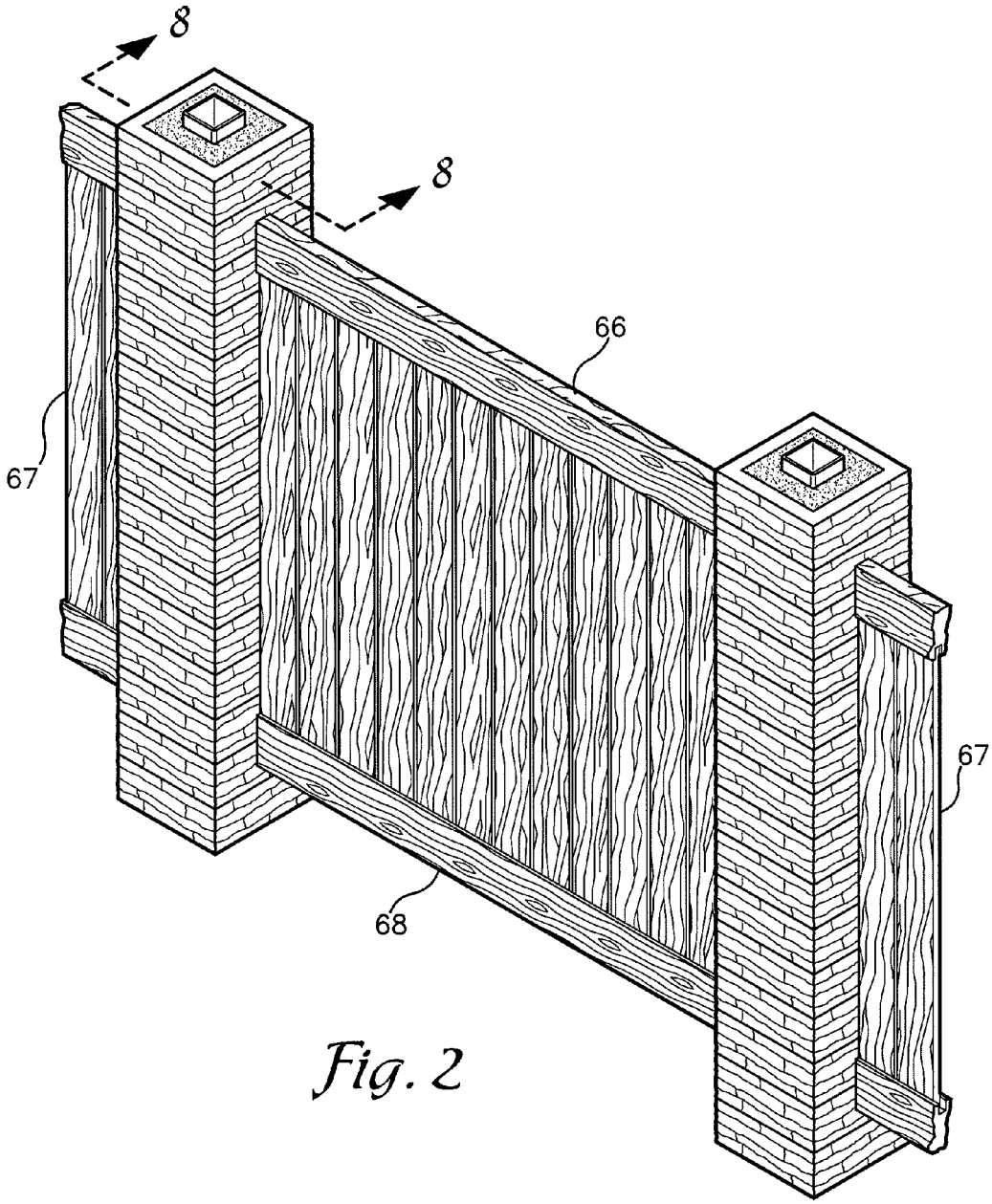
FIG. 2 is a perspective view of a panel fence constructed with modular columns.
Figure 3:
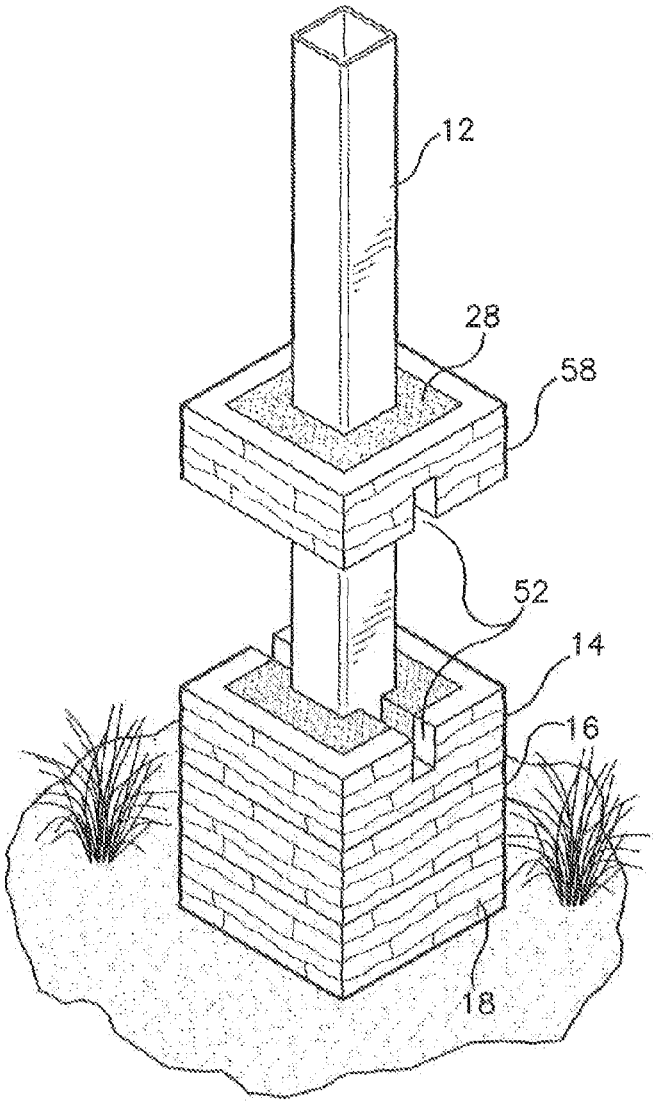
FIG. 3 is a perspective view of a center post of a modular column being constructed with pre-cast ornamental blocks.

Referring now to the drawings wherein like reference numerals refer to similar of identical parts throughout the several views. FIG. 1 reveals a fence section comprised of two modular columns 10 connected by fence rails 54. FIG. 3 details the process by which a modular block 58 is lowered being lowered into position over a post 12 onto several pre-cast blocks 14, 16, 18 already in position. Pre-cast blocks can be used to efficiently and with high aesthetic appeal produce columns 10 for various embodiments of a rail fence such as seen in FIG. 1 as well as for various embodiments of a panel fence such as seen in FIG. 2. Numerous other embodiments and uses of columns utilizing this modular pre-cast block technology are also contemplated and are only limited by the imagination.

Figure 9:
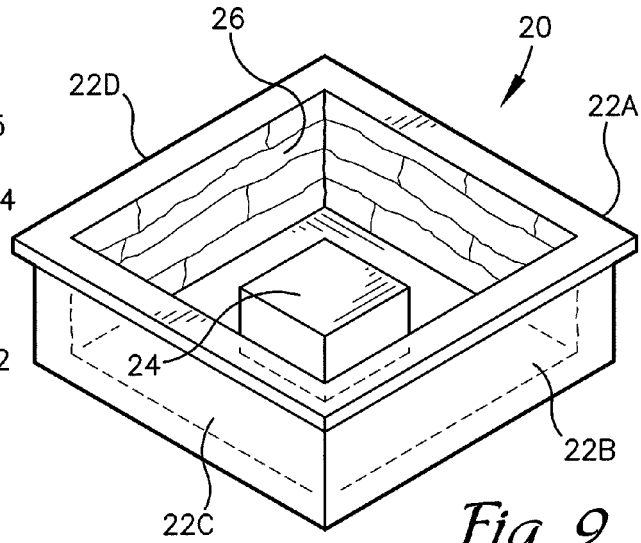
FIG. 9 is a perspective view of an empty mold with a center post for forming a block for use in a modular column.

The production of a pre-cast block 58 begins with the use of a flexible mold 20 such as one produced from silicone and as depicted in FIG. 9. The mold 20 includes four sides 22A, B, C and D a center post 24 as well as textured interior walls 26. The textured interior walls 26 are intended to replicate on the finished modular block a stone face including a desirable and contrasting coloration. Prior to the addition of any cementitious material into the mold 20 the textured interior walls are coated with a coloration mixture of mineral iron oxides, cement, water and an acrylic modifier. The coating is applied consistent with the stone facing molded into the interior walls 26 so as to give the impression that the stone faces are of varying color as might be created by a mason using natural stone. Varying the mineral iron oxides content allows different colors to be formulated to satisfy customer preferences. This coloration mixture may be hand applied to specified portions of the interior wall. Alternatively, automated techniques may also be employed such as the use of robotic systems to apply the coloration mixture.

Figure 10:
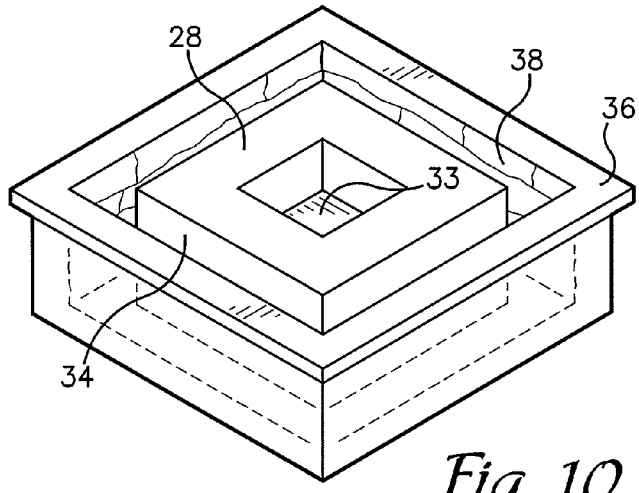
FIG. 10 is a perspective view of a mold showing a compressible insert surrounding the center post used for forming a block for use in a modular column.

Once the subset of the textured interior walls 26 are coated with the above referenced mixture a compressible insert 28 is positioned over the center post 24 as shown in FIG. 10. The compressible insert 28 is lightweight, and preferably comprised of materials such as EPS foam or cellular PVC. The insert 28 includes an upper surface 32, and creates an interior space 33 that will prevent the intrusion of cementitious material and also includes a plurality of exterior walls 34. The insert upper surface 32 is preferably at the same elevation and not above the upper surface 36 of the textured interior walls 26.

Figure 11:
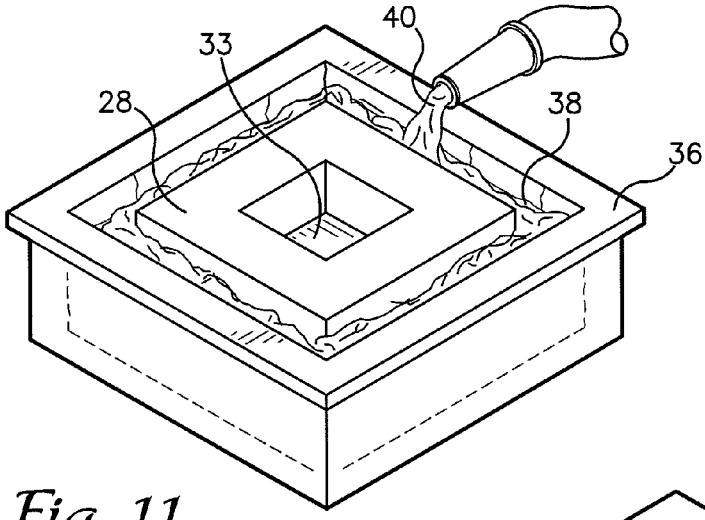
FIG. 11 is a perspective view of a mold showing the addition of a cementitious material to the open area of the mold for forming a block for use in a modular column.

Once the compressible insert 28 is secured in position over the center post 24, the open space 38 between the mold walls 26 and the exterior walls 34 of the compressible insert 28 is filled with a cementitious material 40 as seen in FIG. 11. The cementitious material 40 is preferably a light weight wet cement that readily flows to fill the open space 38. An exemplary mixture of cementitious material would comprise an expanded slate lightweight concrete, such as Stalite™, a dry pigment, aggregates and water combined to form a flowable, lightweight mixture.

Figure 12:
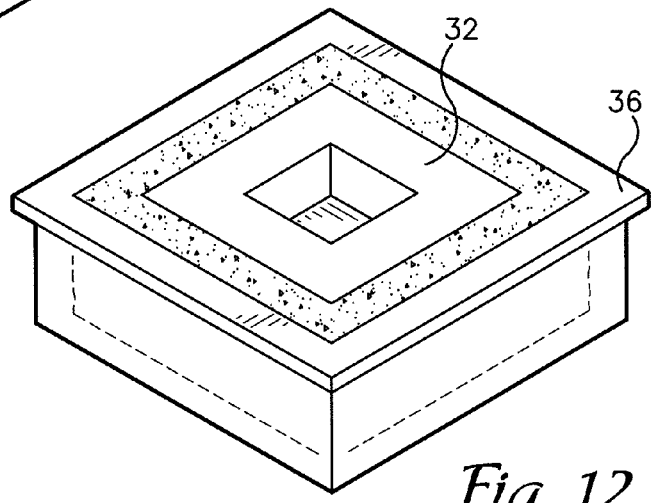
FIG. 12 is a perspective view of a mold showing the cementitious material leveled at the top of the mold for purposes of forming a block for use in a decorative modular column.

Once the open space 38 is completely filled the mold 20 is vibrated to remove voids from the cementitious material 40, allow for settling and to facilitate the movement of the coloration mixture painted onto the mold interior walls 26 into the cementitious material 40 instead of remaining at the surface thereby giving a three dimensional penetration of the coloration mixture into the block and improving the weatherability of the block's surface coloration. In addition, as best seen in FIG. 12, the cementitious material 40 is leveled at the upper surface 36 to create a smooth even surface that facilitates the stackability of the blocks when the cement is cured.

In about twelve hours the cementitious material is fully cured and the block, along with the compressible insert, can be removed from the mold 20. Manipulation of the flexible mold 20, either manually by overturning the mold and popping out the block as is well known in the art, or by injection of air into an orifice in the mold bottom effectively inverting the silicone mold, will facilitate release of the block from the mold 20. Because the cementitious material 40 permeates the pores of the exterior walls 34 of the compressible insert 28, the insert is securely bound to the cementitious material and will not separate during use.

Figure 4:
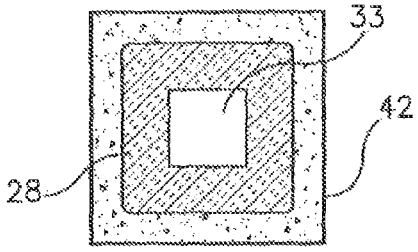
FIG. 4 is a plan view of an embodiment of a pre-cast block without side slots utilized in a modular column.

As seen in FIGS. 4 through 7, alternative embodiments of the block may be cast in the mold 20 with or without slots. FIG. 4 reveals a standard block 42 without slots that would properly be employed, for example, as shown at the lowermost block 18 in the column in FIG. 3. This lowermost slotless block 18 would typically be employed in a column utilizing between one and four fence rails, such as exemplified in FIG. 1.

Figure 5:
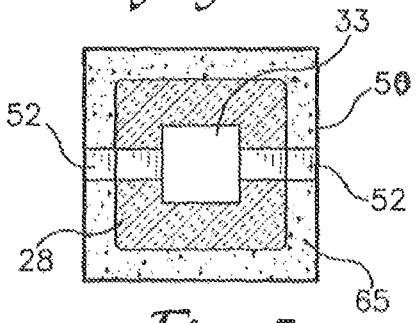
FIG. 5 is a plan view of an embodiment of a pre-cast block with single dimension side slots utilized in a modular column.

An alternative block embodiment as depicted in FIG. 5 reveals a block 50 with slots 52 on opposed sides of the compressible insert 28. These opposing slots 52 serve to hold rails 54 in position as is best seen in FIG. 1. FIG. 3 also serves to highlight how the slot 52 of block 58 integrates with the slot and block 14 positioned immediately below it in the column to create an opening for securing the rail 54 in position. It will be readily apparent to one versed in the construction of columns that the placement of the slots 52 in a modular block 10 may be offset by 90 degrees, instead of 180 degrees, should a block be needed for a corner column with fence rails extending outwardly at 90 degrees instead of 180 degrees. In addition, a block may have only a single slot 52 should a column be needed that is adjacent a building or other structure and the rails need only extend in a single direction.

Figure 6:
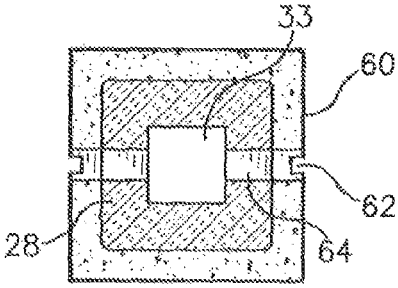
FIG. 6 is a plan view of an embodiment of a block with dual dimension side slots utilized in a modular column.
Figure 7:
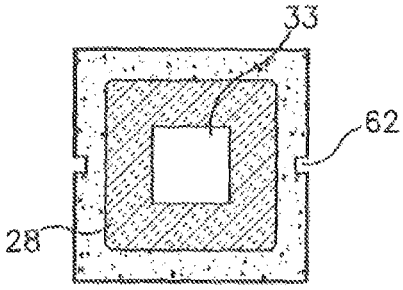
FIG. 7 is a plan view of an embodiment of a block with single dimension side slots utilized in a modular column.
Figure 8:
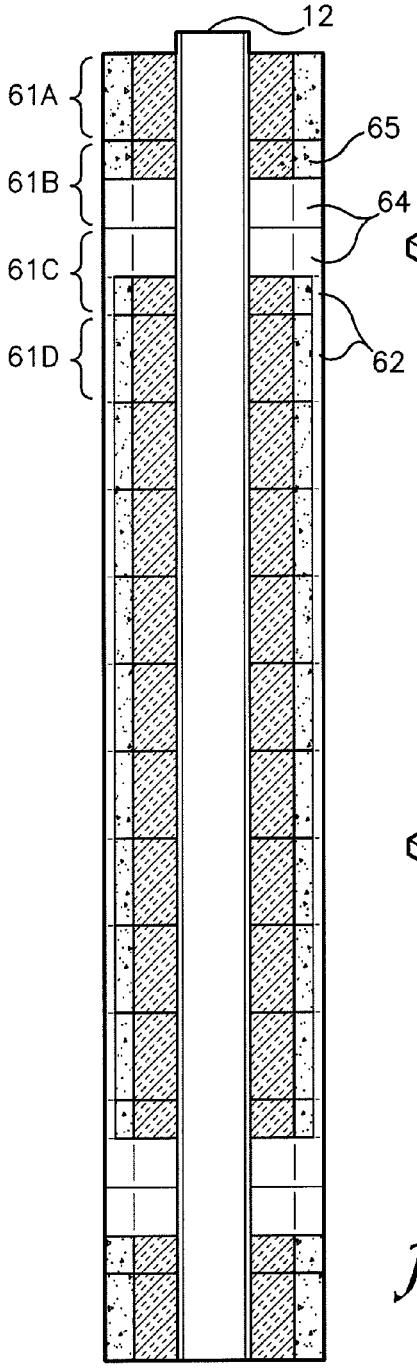
FIG. 8 is a cross sectional view of FIG. 2 revealing the interior features of a modular column.

FIG. 6 depicts a third embodiment of a block 60 that is utilized in the construction of a panel fence such as that shown in FIG. 2. The narrower and shorter slot 62 serves to secure in place the edge of the entire height of the fence panel 67. The configuration of this slot 62 can also be viewed in cross section in FIG. 8 which shows four separate blocks 61A, 61B, 61C and 61D positioned at the top of the column. Block 61A serves as a capping block and includes no slots since the fence panel does not extend upwardly to that height. Block 61B includes an upper exterior surface 65 with no slot and a lower portion with a slot 64. The slot 64 on block 61B, in conjunction with slot 64 in block 61C serves to secure one end of the upper rail 66, as best seen in FIG. 2, in position within the column. Block 61C also includes a small slot 62 that is intended to facilitate securing the top portion of the panel 67 in position. Finally, block 61D includes only a small slot 62 but no larger slot 64, such as that depicted in FIG. 7. The configuration of block 61D is repeated on blocks lower in the column until reaching the lower rail 68 where a similar configuration of blocks is utilized to support the rail 68 and the panel 67 as seen at the top of the column with blocks 61B and 61C. The dimensions of the slots 62, 64 may be tailored to any preferred dimension during production to suit the specific dimensions of the fence rails 66, 68 and panels 67 that are being utilized. To produce slots of the desired dimension one or more inserts are positioned within the mold prior to introduction of the cementitious material 40 or the molds may have the inserts already included. Whether specifically designed into the mold for purpose of occluding the presence of the cementitious material or removable inserts are positioned within the mold 20, once the cementitious material 40 has been cured the slots are formed into the finished block and they are ready for column construction.

The various embodiments of the present invention may be utilized to create a structurally sound and aesthetically pleasing column that can stand alone or be incorporated into a fence of a wide range of configurations including rail fences or panel fences. The use of pre-cast blocks 58 with their aesthetically pleasing exterior surfaces, preconfigured slots and lightweight but structurally rigid material greatly facilitates the construction of the columns. Turning again to FIG. 3, a rigid center post 12 is placed into the ground or secured by some other means so that it stands in a substantially vertical orientation. The center post 12 is preferably a vinyl composition post because of its resistance to weathering and insects, but may be of any sturdy material such as wood, metal or concrete. Additionally, the center post 12 can be of a wide range of dimensions such as 5 inches square or 3 inches square. Alternatively a rectangular of circular configuration for the rigid center post 12 also may be employed. The center post 12 must, however, be of only slightly lesser dimensions than the hole dimension of the compressible insert 28 so that proper alignment of the pre-cast blocks on the modular column 10 can be accomplished.

As seen in FIG. 3, once the center post 12 is secured in a substantially vertical orientation, the central opening 33 of the pre-cast block's 58 compressible insert 28 is aligned over the center post 12. The first pre-cast block 18 to be installed is then moved onto the lowermost support surface which will either typically be a ground surface or a prepared level surface such as concrete. The process of placing additional pre-cast blocks on the column is greatly simplified with the use of a compressible insert 28. The compressible insert material is soft and pliable and therefore will not bind against the center post 12 because of interference between the insert 28 and the post 12. Moreover, as noted above, because of the light weight of the compressible insert and the fact that it occupies a significant percentage of the block interior volume that otherwise would be occupied by cementitious material 40 the pre-cast block weighs far less than a pre-cast block constructed without a compressible insert 28. The nominal weight of a pre-cast block greatly facilitates the construction of a decorative modular column as placement of a pre-cast block with a compressible insert onto a center post 12 requires lesser physical exertion than installation of blocks comprised entirely of cementitious material 40.

As further seen in FIG. 3, a multitude of modular blocks 14, 16, 18, 58 may be placed onto the rigid center post 12 to create a decorative column of any desired height depending upon how the columns is to be employed, for example, as a fence post, a support column or a mailbox stand. If building a fence rail column then, as previously discussed, slots 52, 62, 64 may be configured to satisfy the dimensional requirements of the fence rails and panels. Advantageously, no mortar need be placed between the pre-cast blocks to secure them in position as the blocks simply reside one atop the other creating a seamless textured stone exterior along the entire length of the column. Also advantageously, the compressible insert 28 greatly facilitates the resiliency and longevity of the decorative column 12 in areas where there is heaving of the ground due to the freeze-thaw cycle. Because of these compressible inserts 28, the pre-cast blocks can float on the center post 12 thereby avoiding the accumulation of tensile and compressive forces that can readily fracture hand crafted stone columns or even those with pre-cast blocks that are mortared and locked into fixed positions. For stone columns, such as those shown in FIG. 1, that are employed as fence columns, the thermal expansion of the fencing segments can produce significant lateral loads on the stone columns that can be absorbed by the compressible inserts 28 thereby avoiding damage to the stone columns through cracking of the column materials.

Those skilled in the art appreciate that variations from the specified embodiments disclosed above are contemplated herein and that the described embodiments are not limiting. The description should not be restricted to the above embodiments, but should be measured by the following claims.

We claim:

1. A modular column comprising:

a center post;

a plurality of pre-cast cementitious blocks, each block having a hole extending therethrough so the pre-cast blocks slide onto the center post and remain in place on the center post, each pre-cast block being stacked upon another pre-cast block to achieve a desired column height, the cementitious blocks produced from a mixture of lightweight concrete comprised of rotary kiln expanded slate lightweight aggregate; and a compressible liner completely surrounding the hole of each pre-cast block, wherein the lightweight concrete does not encase an upper surface and a lower surface of the compressible liner, the compressible liner configured to facilitate alignment of the stacked blocks and to prevent binding between the blocks and the center post, a central aperture in the compressible liner comprising a cross-sectional shape dimensionally consistent with a cross-sectional shape of the center post thereby allowing passage of the center post through the compressible liner, wherein the compressible liner is selected from the group consisting of extruded polystyrene foam, expanded polystyrene foam, extruded polypropylene foam, cellulosic foam, polyurethane foam, cellular polyvinyl chloride, polymers of ethylene, propylene, vinyl acetate, diisocyanate, cellulose acetate and isobutylene.

2. The modular column of claim 1, wherein each of the plurality of blocks when in position on the center post includes at least three exterior vertical surfaces and at least one upper and one lower horizontal surface.

3. The modular column of claim 2, wherein at least one of the at least three exterior vertical surfaces includes a slot configured for insertion of an end segment of a fence rail.

4. The modular column of claim 2, wherein at least one of the at least three exterior vertical surfaces includes a slot configured for insertion of an edge of a fence panel.

* * * * *